US007828024B1

(12) United States Patent
Weinstein

(10) Patent No.: US 7,828,024 B1
(45) Date of Patent: Nov. 9, 2010

(54) DOVETAIL JIG

(75) Inventor: Burton Weinstein, New York, NY (US)

(73) Assignee: General Tool Mfg. Co, LLC, New York, NY (US)

( * ) Notice: Subject to any disclaimer, the term of this patent is extended or adjusted under 35 U.S.C. 154(b) by 227 days.

(21) Appl. No.: 12/151,629

(22) Filed: May 7, 2008

(51) Int. Cl.
*B27C 5/00* (2006.01)

(52) U.S. Cl. ..... 144/144.1; 144/145.1; 144/85

(58) Field of Classification Search ..... 144/144.1, 144/144.51, 145.1, 85, 73; 409/125, 130
See application file for complete search history.

(56) References Cited

U.S. PATENT DOCUMENTS 4,074,736 A * 2/1978 Wolff ..... 144/78
4,607,673 A * 8/1986 McCord, Jr. ..... 144/144.51
4,648,433 A * 3/1987 Wolff ..... 144/144.52
5,123,463 A * 6/1992 Grisley ..... 144/83
5,285,832 A * 2/1994 Gibson ..... 144/144.51
5,711,356 A * 1/1998 Grisley ..... 144/144.51

* cited by examiner

*Primary Examiner*—Shelley Self
(74) *Attorney, Agent, or Firm*—Gordon D. Coplein

(57) ABSTRACT

A jig to make the pin and tail parts of a dovetail joint in first and second workpieces has a frame with front, bottom, and top walls. A plurality of spaced rails form first guide slots in a first section of the frame front and top walls and a plurality of posts form second guide slots in a second section of the front wall. Fasteners on the frame bottom wall clamp the jig to one face of the first workpiece with an end facing the plurality of first guide slots and clamp the jig to one face of the second workpiece with the second plurality of guide slots facing the plurality of second guide slots. The guide slots guide a router cutter bit when in each of the first and second slots to cut into respective first and second workpieces ends to make the joint pin and tail parts.

12 Claims, 2 Drawing Sheets

DOVETAIL JIG

FIELD OF THE INVENTION

The present invention relates to a jig used for cutting the pins and tails of a dovetail joint to be made to join the ends of two workpieces.

BACKGROUND OF THE INVENTION

Various jigs, templates, and hand and power operated machines exist for producing dovetail joints. Such a joint typically is used when making drawers and boxes. Reference is made to FIG. 4 which shows two workpieces W1 and W2. A first workpiece W1 has shaped pins 2 at one end and mating shaped tails 3 are at the end of a second workpiece W2. The pins 2 fit into the tails 3 with the ends of the boards being transverse to each other and woodworking glue usually is placed in the spaces where the pins and tails mate to form a secure joint for the two boards. A half blind joint is shown in FIG. 4, that is, the pins 2 extend only part way through the thickness of W1 so that the tails 3 are not seen from one side of W2. On an open type joint the pins 2 would be cut all the way through W1 and would be seen from both sides of W2.

One way for making the dovetail joint pins and tails is to use templates that are generally designed to clamp to the ends of the boards. The boards are held on a workbench so that the collar of a bit of a hand held router can be guided by the template in cutting the pins and tails. There usually is a separate template used to produce each of the dovetail pins and tails. Dovetail machines are more complex and often include one or more stationary router bits, a fairly complicated clamping arrangement for the boards, and a mechanism for sequentially moving a clamped board towards and away from the one or more router bits while simultaneously shifting the one or more bits stepwise to one side to produce the pins and tails at the end of each board. Such machines are often fairly complicated and expensive and also are somewhat difficult to learn to properly operate.

Other types of machines and jigs also are available for forming the pins and tails for a dovetail joint. In using such templates, jigs and machines a different shaped router bit is usually used for making each of the joint pins and tails.

A need exists to provide a craftsman with a jig for forming the pins and tails of dovetail joints that is simple in construction and operation and also is relatively inexpensive.

BRIEF DESCRIPTION OF THE INVENTION

The present invention is concerned with a simple manual jig to be used with a hand held router that provides for the rapid and convenient production of the pins and tails of dovetail joints in boards and workpieces, for example, drawer components and box frames.

In accordance with the invention a one piece jig is provided that requires no templates for making the pins and tails of dovetail joints. The jig has a frame of a generally C shape whose front and top walls portions each are divided into two sections along the frame length. A first section of the front and top walls has a plurality of spaced L-shaped rails with the lower and upper legs of each rail being respectively on the frame front and top walls. The rails form a first set of guide slots of a shape in which a router bit, usually of a dovetail shape, has its collar guided for cutting the pins in the end of a first one of two workpieces. The front wall of the frame second section has posts and the front of the second section top wall has an open area that form a second set of guide slots for the router bit collar to be guided to cut the joint tails in the end of the second workpiece. The bottom wall of the frame has a plurality of thumbscrews along its length that are used to clamp the jig to each of the workpieces with the appropriate set of guide slots opposing the board end into which the pins or tails are to be cut.

A guide plate is provided on the rail upper legs whose position is adjustable relative to the ends of the first set of guide slots formed by the upper legs of the rails. The router rides on the guide plate and its bit collar engages the front edge of the guide plate to control the depth of the cut in the one workpiece in which the pins are made.

In using the jig, the first workpiece flat surface is clamped horizontally to the top of a surface such as a work bench with a piece extending over the bench end. The jig is clamped by the thumbscrews with its first section overlying the workpiece extending piece whose end is against the inner faces of the lower legs of the rails on the frame front wall first section. The adjustable base plate is set to control the length of cut by the router dovetail cutter bit in the first workpiece as the cutter bit is moved in the first set of guide slots to cut the pins.

To cut the tails the second workpiece is held, preferably vertically in a vise, with an end piece extending. The jig is clamped by the thumbscrews to the end of the second workpiece with its second section guide slots overlying the second workpiece extending end piece. The thumbscrews engage one flat surface of the second workpiece extending end piece with the workpiece end face against the inner face of the front wall of the second section and the workpiece opposing flat surface against the inner face of the top wall of the frame second section. The router rides on frame front wall and the router bit collar is guided in the second set of guide slots in the frame second section to cut through the thickness of the second workpiece extending end piece to form the joint tails.

The invention provides a simple one piece jig that is used to cut the pins and tails for a dovetail joint in two workpieces that are to be joined together. The jig is used simply by positioning its proper section over the part of the respective workpiece in which either the pins or the tails are to be cut. No templates need to be provided that have to be positioned on either of the two workpieces.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
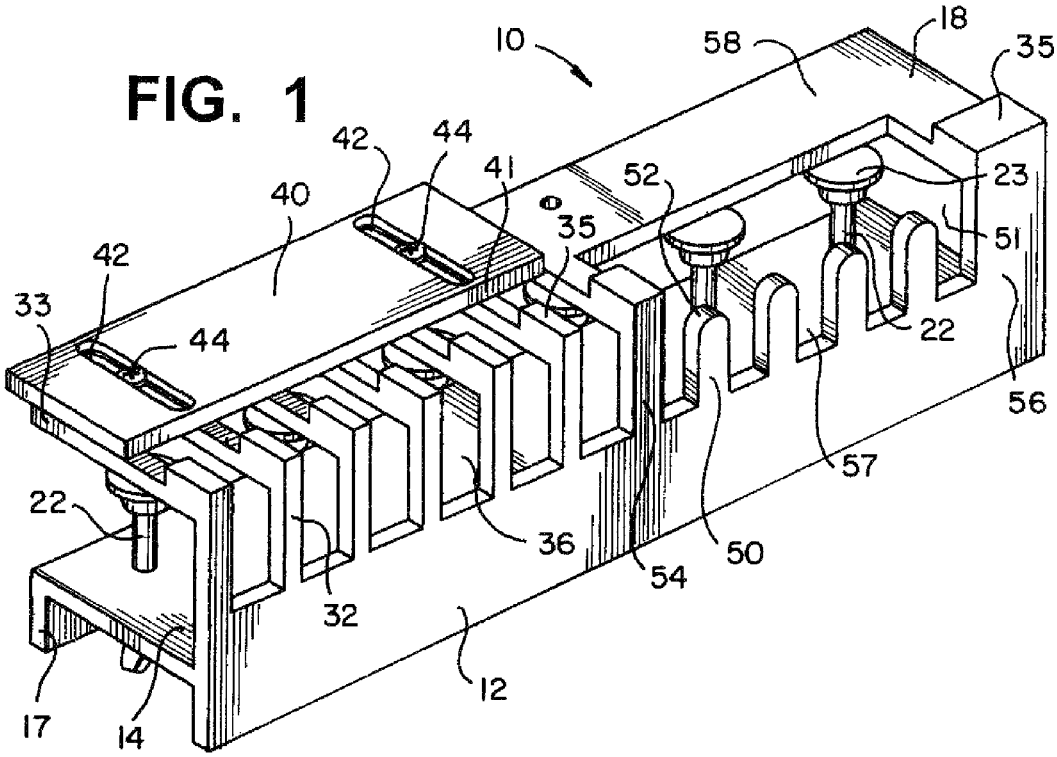
FIG. 1 is a perspective view of the jig.

Referring to FIG. 1, the jig 10 is a generally C-shaped frame that has a vertical (considering the view presented in FIG. 1) front wall 12 with an overall flat front surface and a horizontal top wall 18. Each of the front and upper walls is divided into two sections, described below. A horizontal bottom wall 14 extends transversely from the rear surface of the front wall 12 at a point someone above the bottom end of the front wall. At the rear of the bottom wall 14 is a turned down short vertical wall 17 that with the bottom of the front wall 12 forms a continuous set of legs for the jig to rest on a horizontal surface. A plurality of thumbscrews 22 each having a cap 23 at its upper end facing the inner face of the frame top wall 18 extend vertically through the bottom wall 14 spaced along its length. As many thumb screws can be used as desired.

The upper part of a first section of the front wall 12, the left side as shown in FIG. 1, has a first set of guide slots 36 to guide a router bit collar to cut the pins in the end of a first workpiece. The first set of guide slots 36 are formed by a plurality of spaced L-shaped rails whose lower legs 32 are on upper part of the front wall 12. The upper legs 33 of the rails continue on the front part of the top wall 18 and are joined together (not shown) at their ends at the rear of the top wall. The jig first section starts at the rail 32-33 at one end of the frame (left end as shown in FIG. 1) and continues to an L-shaped stanchion 54 at about the frame center. The collar of a router bit is to be guided in a guide slot 36 formed between the legs 32-33 of two adjacent rails.

A raised ridge 35 is formed on the corner, or junction, of each of the rail legs 32-33. A flat guide plate 40 rests on the rear part of the rail upper legs 33. The guide plate 40 upper surface is at the same level, or in the same plane, as the upper surfaces of the ridges 35. A pair of spaced apart elongated slots 42 are formed through the guide plate 40 across most of its width. Two of the rail upper legs 33 have threaded screw holes each to accept a screw 44 that passes through a guide plate slot 42. The inner edges of each slot 42 are recessed so that the heads of screws 44 do not extend above the base plate top surface. The position of the guide plate 40 can be adjusted by the screws and slots relative to the ridges 35. The router is to ride on guide plate 40 and the cutter bit collar is to engage the guide plate front edge 41. Therefore, the positioning of the guide plate 40 relative to the ridges 35 controls the length of the pins cut in a workpiece by a router bit.

The jig second section (right hand as seen in FIG. 1) is used for cutting the tails of the dovetail joint and it extends from the center stanchion 54 to an end stanchion 56. In the second section the top of the frame front wall 12 and the front of the top wall 18 are cut away to leave an open area 51. A plurality of spaced posts 50 are formed in the open area of the upper part of the front wall 12. Each post 50 has a rounded top end 52 that is below the inner surface of the frame top wall 18. A flat platform 58 extends between the top portions of the center and the end stanchions 54 and 56. Ridges 35 are formed on the upper ends of stanchions 54 and 56 at the front of platform 58 that are of the same height as the ridges on the upper rail legs 33. The posts 50 between the center and end stanchions 54 and 56 define a second se of guide slots 57 for guiding the router bit to make the dovetail joint tails in an end of a second workpiece.

Figure 2:
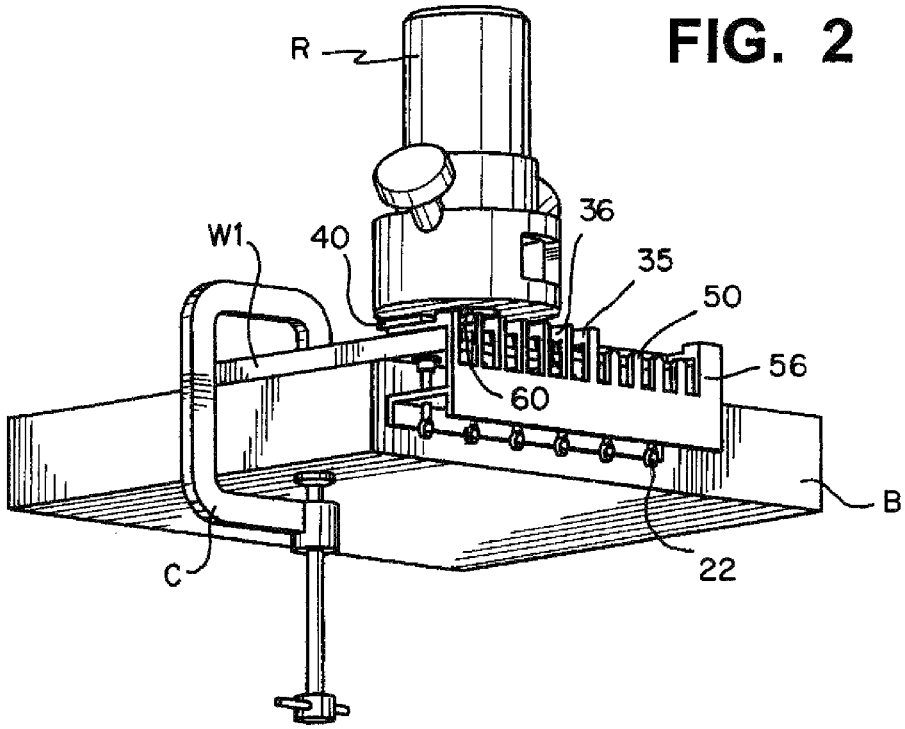
FIG. 2 is a perspective view of the jig positioned to cut the pins of a dovetail joint in a first workpiece.
Figure 3:
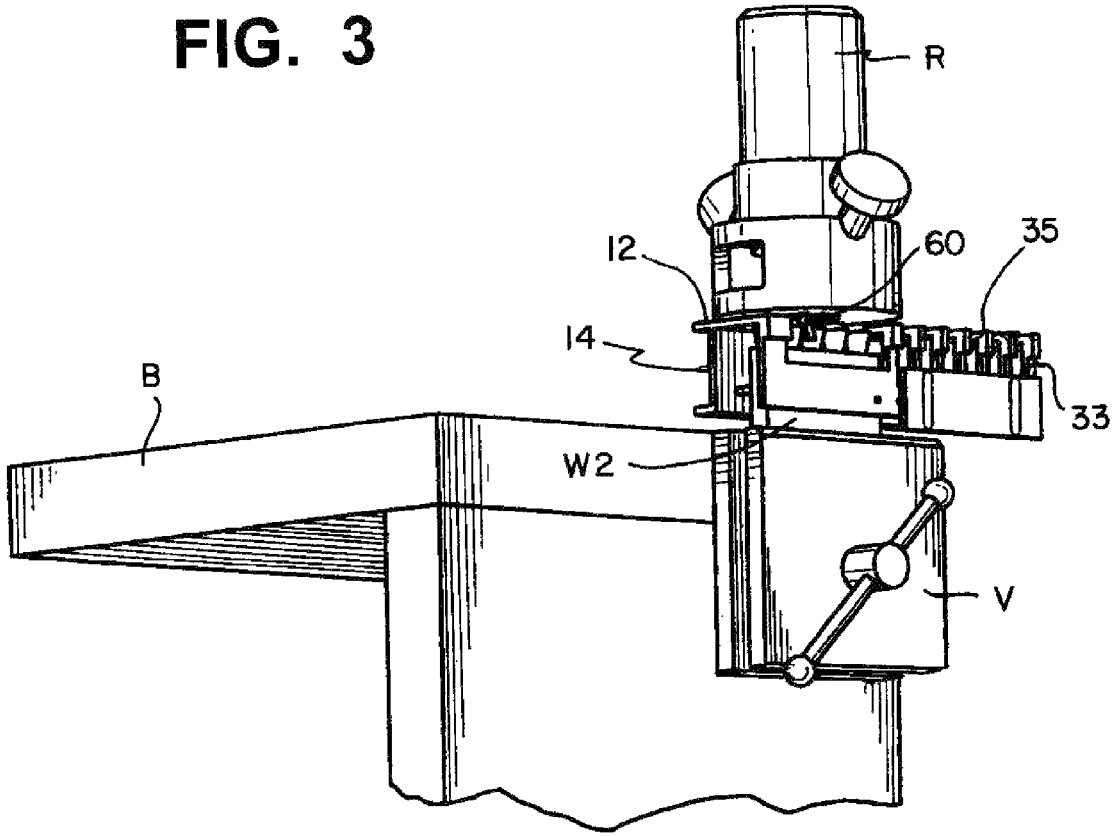
FIG. 3 is a perspective view of the jig positioned to cut the tails of a dovetail joint in a second workpiece.
Figure 4:
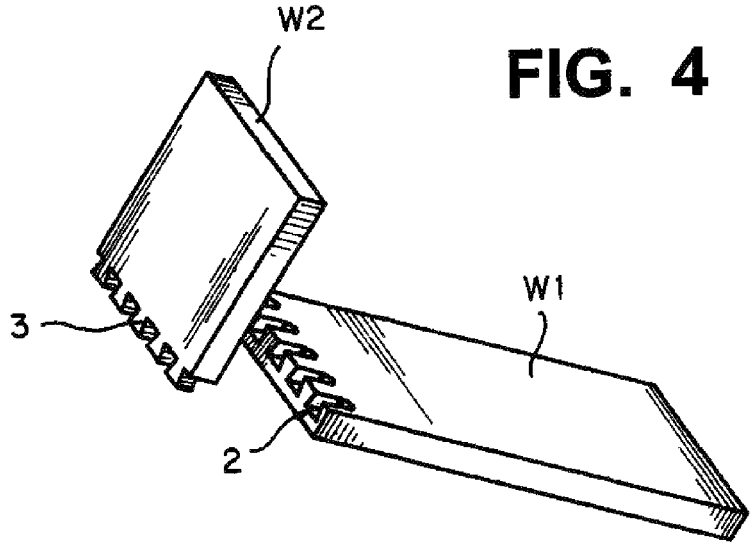
FIG. 4 is a perspective view show the parts of the dovetail joint on two workpieces.

FIGS. 2 and 3 show the use of the use of the jig 10. The operation is described with respect to first making the pins and then the tails. However, either can be cut first. In FIG. 2 the dovetail joint pins are being made using the jig first section. Here, the first workpiece, or board, W1 in which the joint pins are to made is held by a C-clamp C to a flat surface such as a workbench B. An end of the workpiece W1 extends over the workbench end by a sufficient distance so that the first section of jig 10 can be clamped to it using the thumbscrews 32 with the rail lower legs 32 being vertical. The clamping is done with the face of the end edge of workpiece W1 abutting the inner faces of the rail lower legs 32. A router R has a dovetail cutter bit and a collar 60 that guided between two of the upper rail legs 33. The depth (vertical extension) of the cutter bit is adjusted to cut through the thickness of the workpiece W1. The base of router R rests on the guide plate 40 whose position is adjusted by loosening the screws 44, moving the guide plate and then tightening the screws. The guide plate 40 position is set so that the router bit collar will engage the guide plate front edge 41 for making the desired length of cut of the pins in the workpiece W1. As the router R is guided in each of the guide slots 36 formed by the rails 32-33 the proper length of cut for each of the pins will be made in the workpiece W1.

If the type of dovetail joint desired is to be the open and through type then a dovetail cutter bit that corresponds to the thickness of the workpiece is used to cut the pins. If the type of joint to be cut is a half blind joint than a dovetail cutter bit of a smaller size is used for both cuts or the depth of the cutter bit cuts is reduced.

To make the tails for the joint the jig is removed from the first workpiece W1 by loosening the thumbscrews 22. As shown in FIG. 3, the second workpiece W2 is clamped vertically in a vise V attached to the workbench with an end part extending above the vise. The jig is rotated from the position shown in FIG. 2 and clamped by tightening the thumbscrews 22 with the inside of the frame front wall 12 resting on the face of the end edge of workpiece W2 and one flat face of workpiece W2 abutting the inner face of the frame top wall 18. In this position of the frame the front wall posts 50 overlie the end edge of workpiece W2. The location of the workpiece W2 relative to the second section slots 57 is measured along the width of W2 to correctly register the tails to fit with the pins of workpiece W1. The router base rides on the outer surface of the frame front wall 12 and the cutter bit depth is adjusted so that it will cut through the thickness of workpiece W2 as the dovetail cutter bit guide collar 60 follows the edges of the guide slots 57 formed between the posts 50. The router cutter bit collar engages the parts of the front wall 12 between the posts 50 as a stop.

It is possible to cut the tails with the workpiece W2 horizontal as shown in FIG. 2. Here, the jig frame second section would be clamped to the workpiece W2 and the router would be held with its baseplate vertical riding on the frame front wall 12, that is, turned 90° form the router position shown in FIG. 2.

If the type of dovetail joint being made is the through type, then the first set of guide slots 36 can be use to cut both the pins and tails. Here, the tails would be cut with the workpiece W2 vertical as shown in FIG. 3 and the jig first section guide slots clamped over the end of workpiece W2. Alternatively, as described above, workpiece W2 can be horizontal with the first set of guide slots clamped over its end and to router base being vertical and riding on the front face 12. Using the first set of guide slots 36 to make the tails would leave a small part of the joint visible, because the diameter of the router cutter bit leaves a filled section when the straight through tails are joined to the pins. This can be avoided by using the second set of guide slots 57 that round the inner ends of the tails due to the rounded ends 52 of the posts 50 so that the gap will be filled.

A typical dimension for the jig frame is about 13 inches in length so that each of the two frame sections can be used to cut pins and tails in workpieces that are about 6 inches wide. The frame can be made longer if desired. Alternatively, if the widths of the workpieces are wider than the jig first and second section guide slots 36 and 57 used for cutting the pins and tails then the jig thumbscrews 22 are loosened and the jig is moved across the width of the workpiece with a guide slot registered with a previously cut pin or tail, the thumbscrews are tightened, and additional joint pins or tails are cut.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

I claim:

1. A jig for use with a router to make the pin and tail parts of a dovetail joint in the ends of respective first and second workpieces, comprising:

a generally C-shaped frame having a front wall, a bottom wall, and a top wall;

a first set of a plurality of guide slots formed by rails spaced apart in and along the length of a first section of said frame with said rails having parts on both said frame front and top walls, a router being able to move above said top wall rail parts with the router cutter bit being between said front wall rail parts and guided by said top wall rail parts to cut into a first workpiece end to make the joint pin parts; and a second set of a plurality of guide slots formed by posts spaced apart along at least a part of a second section of said frame front wall, said frame front wall and said top wall having continuous adjoining open area sections above and along all of said second set of spaced posts and guide slots into which a router cutter bit enters to cut into the second workpiece and be guided by said posts to cut the second workpiece end to make the joint tail parts.

2. The jig as claimed in claim 1 wherein said rails of said first set of guide slots are L-shaped each having a lower and an upper leg respectively on said front and top walls.

3. The jig as claimed in claim 1 further comprising a plurality of fasteners on said frame that includes at least one first fastener on said frame bottom wall to engage one face of the first workpiece to clamp the jig to the first workpiece with the end of the first workpiece facing said front wall rail parts of said first set of guide slots, and at least one second fastener in said frame second section bottom wall to engage one face of the second workpiece to clamp the jig to the second workpiece with an end of the second workpiece facing said posts of said second set of guide slots.

4. The jig as claimed in claim 3 further comprising a guide plate on said top wall rail parts on which a router is to ride and to engage an edge of said guide plate to set the extent of router bit cut into the first workpiece end.

5. The jig as claimed in claim 4 further comprising a ridge on at least some of said rails of said first section at the junction of said top wall rail parts and front wall rail parts of the rails having a said ridge, the top surface of said ridges being in the same plane as the top surface of said guide plate.

6. The jig as claimed in claim 4 wherein said guide plate has a plurality of slots in the direction of said top wall rail parts, and further comprising a fastener extending through said guide plate slot to engage a top wall rail part.

7. The jig as claimed in claim 5 wherein said guide plate has a plurality of slots in the direction of said top wall rail parts, and further comprising a fastener extending through said guide plate slot to engage a top wall rail part.

8. The jig as claimed in claim 2 further comprising a guide plate on said upper rail legs on which a router is to ride and the router cutter bit is to engage an edge of said guide plate to set the extent of router bit cut into the first workpiece end.

9. The jig as claimed in claim 8 further comprising a raised ridge on the upper rail leg of at least some of said L-shaped rails at the corner of the junction with the respective L-shaped rail lower leg.

10. The jig as claimed in claim 8 wherein said guide plate has a plurality of slots in the direction of said upper rail legs, and further comprising a fastener extending through said guide plate slot to engage an upper rail leg to adjust the position of said guide plate relative to said raised ridges.

11. A jig for use with a router to make the pin and tail parts of a dovetail joint in the ends of respective first and second workpieces, comprising:

a generally C-shaped frame having a front wall, a bottom wall, and a top wall;

a first set of a plurality of guide slots formed by a plurality of L-shaped rails each having a lower and an upper leg respectively on each of said front and top walls spaced apart in and along the length of a first section of said frame front and top walls, a router cutter bit to be moved between said lower legs of said rails and be guided by said upper legs of said rails to cut into a first workpiece end to make the joint pin parts;

a second set of a plurality of guide slots formed by a plurality of posts spaced apart along at least a part of a second section of said frame front wall and an open section in said frame top wall above said posts by which a router cutter bit enters the second work piece to be guided by said posts to cut into a second workpiece end to make the joint tail parts; and a plurality of fasteners on said frame bottom wall, at least one said fastener to engage one face of the first workpiece to clamp the jig to the first workpiece with the end of the first workpiece facing said lower rail legs of said first set of guide slots, and at least one fastener to engage one face of the second workpiece to clamp the jig to the second workpiece with an end of the second workpiece facing said posts of said second set of guide slots; and a guide plate on said upper rail legs on which a router is to ride and the router cutter bit is to engage an edge of said guide plate to set the extent of router bit cut into the first workpiece end; and wherein the corner of at least some of said upper rail legs at the junction with a respective lower leg has a raised ridge; and said guide plate having an upper surface substantially flush with the upper surface of each said raised ridge.

12. The jig as claimed in claim 11 wherein said guide plate has a plurality of slots in the direction of said upper rail legs, and further comprising a fastener extending through said guide plate slot to engage an upper rail leg to adjust the position of said guide plate relative to said raised ridges.

* * * * *